US010119221B2

(12) United States Patent
Nam et al.

(10) Patent No.: US 10,119,221 B2
(45) Date of Patent: Nov. 6, 2018

(54) CLOTHES TREATMENT APPARATUS AND METHOD OF CONTROLLING THE SAME

(71) Applicant: LG Electronics Inc., Seoul (KR)

(72) Inventors: Wansik Nam, Seoul (KR); Youngjin Doh, Seoul (KR); Junyoung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 28 days.

(21) Appl. No.: 15/072,554

(22) Filed: Mar. 17, 2016

(65) Prior Publication Data

US 2016/0273153 A1 Sep. 22, 2016

(30) Foreign Application Priority Data

Mar. 17, 2015 (KR) ..... 10-2015-0036660

(51) Int. Cl.
*D06F 71/34* (2006.01)
*D06F 39/00* (2006.01)
(Continued)

(52) U.S. Cl.
CPC ..... *D06F 71/34* (2013.01); *D06F 39/008* (2013.01); *D06F 58/10* (2013.01); *D06F 58/203* (2013.01);
(Continued)

(58) Field of Classification Search
CPC ..... D06F 71/34; D06F 17/12; D06F 58/10; D06F 39/008
(Continued)

(56) References Cited

U.S. PATENT DOCUMENTS 5,305,484 A 4/1994 Fitzpatrick et al.
6,189,346 B1 2/2001 Chen et al.
(Continued)

FOREIGN PATENT DOCUMENTS

EP 2182104 A2 * 5/2010 ..... D06F 25/00
EP 2733257 5/2014
(Continued)

OTHER PUBLICATIONS

Extended European Search Report issued in European Application No. 16160666.0 dated Jul. 25, 2016, 10 pages.
(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

A clothes treatment apparatus includes a case that defines a treatment chamber that is configured to receive clothes. The clothes treatment apparatus further includes a steam unit that is configured to supply steam to the treatment chamber. The clothes treatment apparatus further includes a blower unit that is configured to draw air from the treatment chamber. The clothes treatment apparatus further includes an inlet temperature sensor that is configured to measure an inlet temperature of air drawn by the blower unit. The clothes treatment apparatus further includes a heat pump unit that is configured to heat air drawn by the blower unit and that is configured to supply heated air to the treatment chamber. The clothes treatment apparatus further includes a control unit that is configured to control the steam unit, the blower unit, and the heat pump unit.

10 Claims, 6 Drawing Sheets

(51) Int. Cl.
*D06F 58/10* (2006.01)
*D06F 58/28* (2006.01)
*D06F 58/20* (2006.01)

(52) U.S. Cl.
CPC ..... *D06F 58/28* (2013.01); *D06F 2058/287* (2013.01); *D06F 2058/2829* (2013.01); *D06F 2058/2854* (2013.01)

(58) Field of Classification Search
USPC ..... 8/149.3; 68/5 R
See application file for complete search history.

(56) References Cited

U.S. PATENT DOCUMENTS 8,539,694 B2 9/2013 Moon et al.
2006/0288605 A1* 12/2006 Carow ..... D06F 58/28 34/446
2008/0148493 A1* 6/2008 Hong ..... D06F 58/10 8/149.3
2009/0064531 A1* 3/2009 Moon ..... D06F 58/10 34/491
2010/0132130 A1* 6/2010 Moon ..... D06F 58/10 8/137
2013/0198971 A1* 8/2013 Doh ..... D06F 29/00 8/137

FOREIGN PATENT DOCUMENTS

FR 2920160 2/2009
JP 2012-254207 12/2012
KR 10-2009-0013946 2/2009
KR 10-2011-0000083 1/2011
WO 2009/020311 2/2009
WO 2009/020320 2/2009

OTHER PUBLICATIONS

International Search Report and Written Opinion in International Application No. PCT/KR2016/002683, dated Jul. 21, 2016, 12 pages.

* cited by examiner

CLOTHES TREATMENT APPARATUS AND METHOD OF CONTROLLING THE SAME

FIELD

The present disclosure relates to a clothes treatment apparatus.

BACKGROUND

Clothes treatment apparatuses are apparatuses that treat clothes, e.g. wash and dry clothes and remove wrinkles from clothes, at home or in laundromats.

Clothes treatment apparatuses may be classified into a washer for washing clothes, a dryer for drying clothes, a washer/dryer having both a washing function and a drying function, a refresher for refreshing clothes, and a steamer for removing wrinkles from clothes.

The refresher is an apparatus that keep clothes comfortable and fresh. The refresher functions to dry clothes, to supply fragrance to clothes, to prevent the occurrence of static electricity in clothes, or to remove wrinkles from clothes.

The steamer is an apparatus that supplies steam to clothes in order to remove wrinkles from the clothes. Unlike a general iron, the steamer gently removes wrinkles from the clothes without direct contact between the clothes and a heating plate.

SUMMARY

According to an innovative aspect of the subject matter described in this application, a clothes treatment apparatus includes: a case that defines a treatment chamber that is configured to receive clothes; a steam unit that is configured to supply steam to the treatment chamber; a blower unit that is configured to draw air from the treatment chamber; an inlet temperature sensor that is configured to measure an inlet temperature of air drawn by the blower unit; a heat pump unit that is configured to heat air drawn by the blower unit and that is configured to supply heated air to the treatment chamber; and a control unit that is configured to control the steam unit, the blower unit, and the heat pump unit.

The clothes treatment apparatus may include one or more of the following optional features. The control unit is configured to control operation of the heat pump unit based on a preheated inlet temperature (T1) that is measured by the inlet temperature sensor at a time of the blower unit beginning to operate and the steam unit performing preheating. At the time of the blower unit beginning to operate and the steam unit performing preheating, the heat pump unit is not operating. The control unit is configured to, based on the preheated inlet temperature (T1) being equal to or higher than a predetermined reference inlet temperature (T_in), control the heat pump unit to heat air, that is drawn by the blower unit, at a slower rate than based on the preheated inlet temperature (T1) being lower than the reference inlet temperature (T_in). The control unit is configured to control the heat pump unit based on a comparison of a dried inlet temperature (T2), that the inlet temperature sensor measures while the control unit operates the heat pump unit, with the preheated inlet temperature (T1).

The control unit is configured to, based on the preheated inlet temperature (T1) being lower than a predetermined reference inlet temperature (T_in), and based on a difference between the dried inlet temperature (T2) and the preheated inlet temperature (T1) being equal to or higher than a predetermined first reference temperature difference (ΔD1), halt operation of the heat pump unit. The control unit is configured to, based on the preheated inlet temperature (T1) being equal to or higher than the reference inlet temperature (T_in), and based on a difference between the dried inlet temperature (T2) and the preheated inlet temperature (T1) being equal to or higher than a predetermined second temperature difference (ΔD2), halt operation of the heat pump unit. The second reference temperature difference (ΔD2) is less than the first reference temperature difference (ΔD1). The heat pump unit includes a compressor that is configured to compress refrigerant and a condenser that is configured to exchange heat between the refrigerant compressed by the compressor and the air drawn by the blower unit.

The control unit is configured to operate the compressor at a predetermined first operating speed (V1) based on the preheated inlet temperature (T1) being lower than a predetermined reference inlet temperature (T_in). The control unit is configured to operate the compressor at a predetermined second operating speed (V2) based on the preheated inlet temperature (T1) being equal to or higher than the reference inlet temperature (T_in). The second operating speed (V2) is lower than the first operating speed (V1). The control unit is configured to halt operation of the compressor based on a difference between a dried inlet temperature (T2), that the inlet temperature sensor measures while the compressor operates at the first operating speed (V1), and based on the preheated inlet temperature (T1) being equal to or higher than a first reference temperature difference (ΔD1). The control unit is configured to halt operation of the compressor based on the difference between a dried inlet temperature (T2), that the inlet temperature sensor measures while the compressor operates at the second operating speed (V2), and based on the preheated inlet temperature (T1) being equal to or higher than a second reference temperature difference (ΔD2). The second reference temperature difference (ΔD2) is less than the first reference temperature difference (ΔD1).

According to another innovative aspect of the subject matter described in this application, a method of controlling a clothes treatment apparatus that includes: a case that defines a treatment chamber that is configured to receive clothes, a steam unit that is configured to supply steam to the treatment chamber; a blower unit that is configured to draw air from the treatment chamber; an inlet temperature sensor that is configured to measure an inlet temperature of air drawn by the blower unit; and a heat pump unit that is configured to heat air drawn by the blower unit and that is configured to supply heated air to the treatment chamber. The method includes the actions of operating the blower unit; in response to operating the blower unit, preheating the steam unit and measuring a preheated inlet temperature (T1) of air drawn by the blower unit; supplying, by the steam unit, steam to the treatment chamber; lowering a temperature inside the treatment chamber by operating the blower unit after halting operation of the steam unit; and based on the preheated inlet temperature (T1), heating air drawn by the blower unit and discharging heated air into the treatment chamber by controlling the heat pump unit.

The method may include one or more of the following optional features. The action of operating the blower unit includes not operating the heat pump unit. The steam unit is preheated and the inlet temperature (T1) is measured in response to operating the blower unit and not operating the heat pump unit. The heat pump unit is configured to, based on the preheated inlet temperature (T1) being equal to or higher than a predetermined reference inlet temperature (T_in), heat air drawn by the blower unit at a slower rate than based on the preheated inlet temperature (T1) being lower than the reference inlet temperature (T_in). The actions further include measuring a dried inlet temperature (T2), that is a temperature of air drawn by the blower unit while the heat pump unit operates; and halting operation of the heat pump unit based on a difference between the dried inlet temperature (T2) and the preheated inlet temperature (T1).

The actions further include halting operation of the heat pump unit based on the preheated inlet temperature (T1) being lower than a predetermined reference inlet temperature (T_in), and based on a difference between the dried inlet temperature (T2) and the preheated inlet temperature (T1) being equal to or greater than a predetermined first reference temperature difference (ΔD1), halting operation of the heat pump unit based on the preheated inlet temperature (T1) being equal to or higher than the predetermined reference inlet temperature (T_in), and based on a difference between the dried inlet temperature (T2) and the preheated inlet temperature (T1) being equal to or greater than a predetermined second reference temperature difference (ΔD2), and the second reference temperature difference (ΔD2) is less than the first reference temperature difference (ΔD1). The heat pump unit includes a compressor that is configured to compress refrigerant and a condenser that is configured to exchange heat between the refrigerant compressed by the compressor and the air drawn by the blower unit.

The compressor is configured to operate at a predetermined first operating speed (V1) based on the preheated inlet temperature (T1) being lower than a predetermined reference inlet temperature (T_in). The compressor is configured to operate at a predetermined second operating speed (V2) based on the preheated inlet temperature (T1) being equal to or higher than a predetermined reference inlet temperature (T_in). The second operating speed (V2) is lower than the first operating speed (V1). The actions further include halting operation of the compressor based on a difference between a dried inlet temperature (T2), that the inlet temperature sensor measures while the compressor operates at the first operating speed (V1), and based on the preheated inlet temperature (T1) being equal to or higher than a first reference temperature difference (ΔD1), and halting operation of the compressor based on the difference between a dried inlet temperature (T2), that the inlet temperature sensor measures while the compressor operates at the second operating speed (V2), and based on the preheated inlet temperature (T1) being equal to or higher than a second reference temperature difference (ΔD2). The second reference temperature difference (ΔD2) is less than the first reference temperature difference (ΔD1).

It is an object of the subject matter described in this application to provide a clothes treatment apparatus, which control a drying cycle in accordance with the environment in which the apparatus is installed.

DETAILED DESCRIPTION

Figure 1:
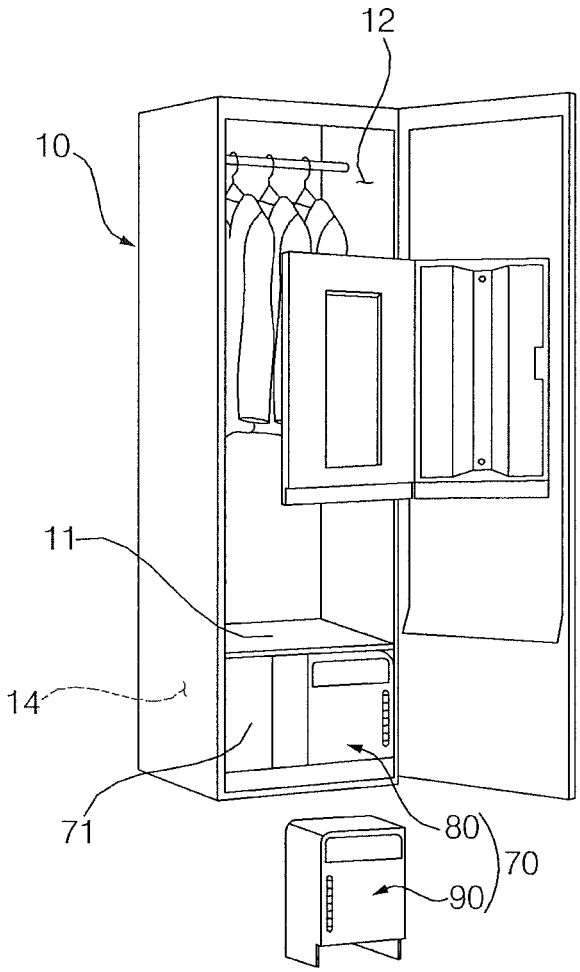
FIG. 1 is a perspective view of an example clothes treatment apparatus.
Figure 2:
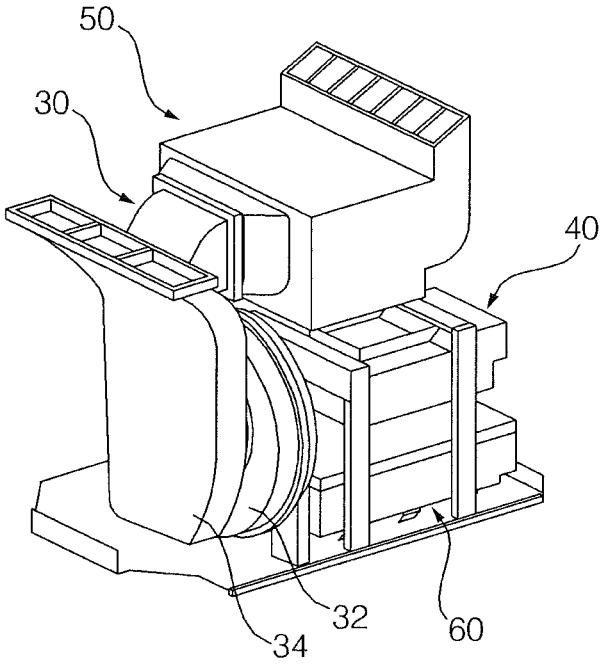
FIG. 2 is a perspective view of example components of an example clothes treatment apparatus.
Figure 3:
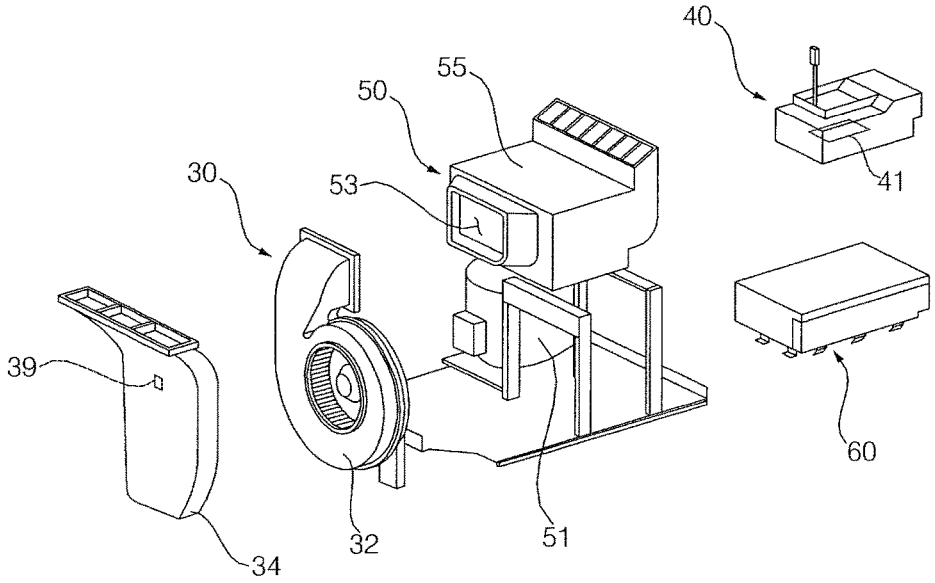
FIG. 3 is an exploded perspective view of example components of an example clothes treatment apparatus.
Figure 4:
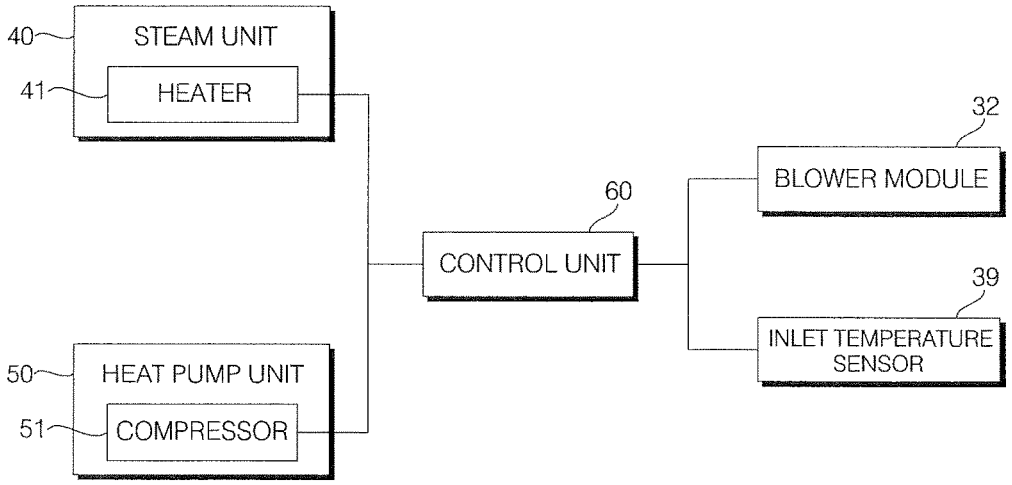
FIG. 4 is a block diagram of an example clothes treatment apparatus.

FIG. 1 illustrates an example clothes treatment apparatus. FIG. 2 illustrates example components of an example clothes treatment apparatus. FIG. 3 illustrates an example partial construction of an example clothes treatment apparatus. FIG. 4 illustrates an example clothes treatment apparatus.

The clothes treatment apparatus includes a case 10 defining therein a treatment chamber 12 for accommodating clothes, a steam unit 40 for supplying steam to the treatment chamber 12, a blower unit 30 for drawing air from the treatment chamber 12, an inlet temperature sensor 39 for measuring the inlet temperature, which is a temperature of the air drawn by the blower unit 30, a heat pump unit 50 for heating the air drawn by the blower unit 30 to supply the heated air into the treatment chamber 12, and a control unit 60 for controlling the steam unit 40, the blower unit 30 and the heat pump unit 50.

The case 10 is provided with a partition plate 11 for dividing the internal space into upper and lower parts, that is, a treatment chamber 12, which is defined above the partition plate 11 so as to accommodate clothes, and a cycle chamber 14, which is defined below the partition plate 11 so as to accommodate mechanical devices.

The case 10 is provided with a door 20 for opening or closing the front face of the case 10.

The treatment chamber 12 accommodates clothes, and the clothes accommodated in the treatment chamber 12 are treated by the circulation of steam or air, drying or the like so as to remove wrinkles or odors from the clothes.

The cycle chamber 14 is provided therein with the blower unit 30 for drawing air in the treatment chamber 12 thereinto and circulating the air, the steam unit 40 for supplying steam to the treatment chamber 12, the heat pump unit 50 for supplying heated air to the treatment chamber 12, and a control unit 60 for controlling the blower unit 30, the steam unit 40 and the heat pump unit 50.

The blower unit 30 draws the air from the treatment chamber 12 under the control of the control unit 60. The air drawn into the blower unit 30 is discharged to the heat pump unit 50.

The blower unit 30 includes a blower module 32 for drawing the air in the treatment chamber 12 and discharging the air to the heat pump unit 50 by causing the air to flow through rotation of a fan, and an inlet duct 34, which is disposed at the inlet side of the blower module 32 so as to guide the air in the treatment chamber 12 toward the blower module 32.

One side of the inlet duct 34 is connected to the treatment chamber 12, and the other side of the inlet duct 34 is connected to the blower module 32. The inlet duct 34 is provided therein with the inlet temperature sensor 39 for measuring the inlet temperature, which is the temperature of the air flowing in the inlet duct 34. The inlet temperature sensor 39 measures the inlet temperature, which is the temperature of the air drawn into the inlet duct 34 from the treatment chamber 12, and transfers the inlet temperature to the control unit 60.

One side of the blower module 32 is connected to the inlet duct 34, and the other side of the blower module 32 is connected to the heat pump unit 50. The blower module 32 is a single module into which a sirocco fan, a duct and a motor are incorporated.

The steam unit 40 supplies steam to the treatment chamber 12 under the control of the control unit 60. The steam unit 40 generates heat by application of power. The steam unit 40 receives water from a separate water supply tank, and heats the water so as to convert the water into steam.

The steam generated from the steam unit 40 is discharged to the treatment chamber 12. In some implementations, the steam generated from the steam unit 40 flows to the treatment chamber 12 through a flow channel of the heat pump unit 50. In some implementations, the steam unit 40 is connected to the heat pump unit 50.

The steam unit 40 includes a heater 41 for heating water. The steam unit 40 first heats the heater 41 and then generates steam under the control of the control unit 60.

The heat pump unit 50 heats the air drawn by the blower unit 30 under the control of the control unit 60. The heat pump unit 50 supplies the heated air to the treatment chamber 12.

The heat pump unit 50 is constituted by a refrigeration cycle, which includes a compressor 51, a condenser 53, an evaporator and an expansion valve. The heat pump unit 50 includes a heat pump channel 55, in which the condenser 53 is disposed and which has a flow channel defined therein.

The compressor 51 compresses refrigerant so as to cause the refrigerant to be in a high-temperature and high-pressure state. The condenser 53 facilitates the exchange of heat between the refrigerant compressed in the compressor and the air drawn by the blower unit 30 so as to heat the air. The expansion valve expands the refrigerant condensed in the condenser 53, and the evaporator evaporates the refrigerant expanded at the expansion valve. The evaporated refrigerant is recovered into the compressor 51.

One side of the heat pump channel 55 is connected to the blower module 32 of the blower unit 30, and the other side of the heat pump channel 55 is connected to the treatment chamber 12. The condenser 53 is disposed in the heat pump channel 55.

A tank module 70 for storing water is disposed in front of the cycle chamber 14. In some implementations, a tank module frame 71, on which the tank module 70 is mounted, is disposed in front of the inlet duct 34.

The tank module 70 includes a water supply tank 80 for supplying water to the steam unit 40 and a drain tank 90 for storing condensed water collected in the treatment chamber 12. The water supply tank 80 is connected to the steam unit 40 so as to supply water to the steam unit 40, and the drain tank 90 is connected to the treatment chamber 12 so as to store water condensed in the treatment chamber 12 or the heat pump unit 50.

The control unit 60 receives an inlet temperature from the inlet temperature sensor 39. The control unit 60 controls the steam unit 40, the blower unit 30 and the heat pump unit 50 in accordance with user settings or the inlet temperature such that the clothes treatment apparatus performs respective treatment cycles in compliance with the set course. The respective cycles of treating clothes will be described later with reference to FIG. 5.

The control unit 60 operates the blower unit 30 while preheating the steam unit 40 so as to control the heat pump unit 50 based on the preheated inlet temperature, measured by the inlet temperature sensor 39.

When the preheated inlet temperature is equal to or higher than a predetermined reference inlet temperature, the control unit 60 controls the heat pump unit 50 to heat the air drawn by the blower unit 30 more slowly than in the case in which the preheated inlet temperature is lower than the reference inlet temperature.

More specifically, the control unit 60 operates the compressor 51 at a predetermined first operating speed when the preheated inlet temperature is lower than the reference inlet temperature, and operates the compressor 51 at a predetermined second operating speed, which is lower than the first operating speed, when the preheated inlet temperature is equal to or higher than the reference inlet temperature. The operating speed of the compressor 51, which is the rotational speed of a motor for generating the rotational force required to compress refrigerant, may be expressed as a frequency. The operating speed of the compressor 51 is proportional to the compression ability of the compressor 51. The higher the operating speed of the compressor 51, the quicker the heat pump unit 50 heats air. The lower the operating speed of the compressor 51, the slower the heat pump unit 50 heats air. When the heat pump unit 50 heats air, the control unit 60 controls the heat pump unit 50 based on the result of a comparison between the dried inlet temperature measured by the inlet temperature sensor 39, and the preheated inlet temperature. In some implementations, the control unit 60 halts the operation of the heat pump unit 50 depending on the difference between the dried inlet temperature and the preheated inlet temperature.

In some implementations, the preheated inlet temperature is lower than the reference inlet temperature, and the control unit 60 operates the heat pump unit 50 to heat the air drawn by the blower unit 30 and discharge the heated air into the treatment chamber 12. At this time, when the difference between the dried inlet temperature measured by the inlet temperature sensor 39 and the preheated inlet temperature is equal to or greater than a predetermined first reference temperature difference, the control unit 60 halts the operation of the heat pump unit 50. In some implementations, the preheated inlet temperature is equal to or higher than the reference inlet temperature, and the control unit 60 operates the heat pump unit 50 and discharges the heated air into the treatment chamber 12. At this time, when the difference between the dried inlet temperature and the preheated inlet temperature is equal to or greater than a predetermined second reference temperature difference, the control unit 60 halts the operation of the heat pump unit 50. Here, the second reference temperature difference is less than the first reference temperature difference.

In some implementations, the control unit 60 operates the compressor 51 at a first operating speed, and when the difference between the dried inlet temperature measured by the inlet temperature sensor 39 and the preheated inlet temperature is equal to or greater than the predetermined first reference temperature difference, the control unit 60 halts the operation of the compressor 51. In some implementations, the control unit 60 operates the compressor 51 at a second operating speed, and when the difference between the dried inlet temperature measured by the inlet temperature sensor 39 and the preheated inlet temperature is equal to or greater than the predetermined first reference temperature difference, the control unit 60 halts the operation of the compressor 51. Here, the second reference temperature difference is less than the first reference temperature difference.

A detailed description regarding this control will be made below with reference to FIGS. 5 and 6.

Figure 5:
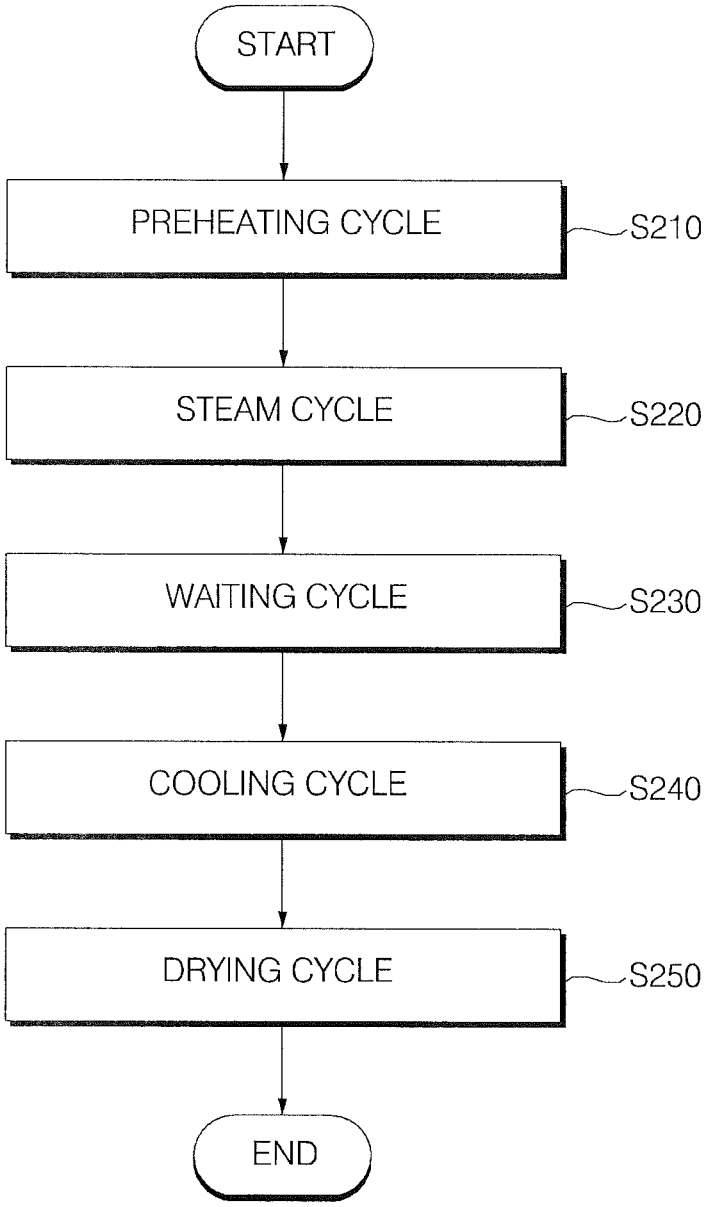
FIG. 5 is a flowchart illustrating example cycles of an example clothes treatment apparatus.

FIG. 5 illustrates example cycles of an example clothes treatment apparatus. FIG. 6 illustrates an example control process of an example clothes treatment apparatus.

FIG. 5 illustrates respective cycles of a general course, in which some of the cycles may be omitted or changed in sequence.

When a user initiates operation of the clothes treatment apparatus, the control unit 60 performs a preheating cycle S210 of supplying power to the heater 41 of the steam unit 40 to preheat the heater 41.

In the preheating cycle S210, the control unit 60 operates the blower module 32 of the blower unit 30. During the preheating cycle S210, the heat pump unit 50 is not operated. When the blower module 32 is started to operate, the inlet temperature sensor 39 measures the temperature of the air drawn into the inlet duct 34 of the blower unit 30, and transfers the measured preheated inlet temperature to the control unit 60.

When the preheating of the heater 41 is completed, the control unit 60 performs a steam cycle S220. In the steam cycle S220, the control unit 60 supplies the water in the water supply tank 80 to the steam unit 40 so as t create steam, and supplies the steam to the treatment chamber 12. The control unit 60 operates the blower module 32 to circulate the air in the treatment chamber 12. During the steam cycle S220, the heat pump unit 50 is not operated.

After a predetermined period of time has elapsed, the control unit 60 halts the operation of the steam unit 40 so as to terminate the steam cycle S220.

After the steam cycle S220, the control unit 60 performs a waiting cycle S230 and a cooling cycle S240. After the operation of the steam unit 40 is halted, the control unit 60 rotates the blower module at a relatively low RPM, and performs the waiting cycle S230 so as to allow the clothes to be sufficiently treated with steam.

After a predetermined period of time has elapsed, the control unit 60 performs the cooling cycle S240 of rotating the blower module 32 at a relatively higher RPM to lower the temperature inside the treatment chamber 12.

After a predetermined period of time has elapsed, the control unit 60 terminates the cooling cycle S240.

After the cooling cycle S240, the control unit 60 performs a drying cycle S250 by operating the blower module 32 and operating the compressor 51 of the heat pump unit 50 so as to supply the heated air to the treatment chamber 12.

The state of operation of the compressor 51 in the drying cycle S250 and the state of termination of the drying cycle S250 will be described below with reference to FIG. 6.

Figure 6:
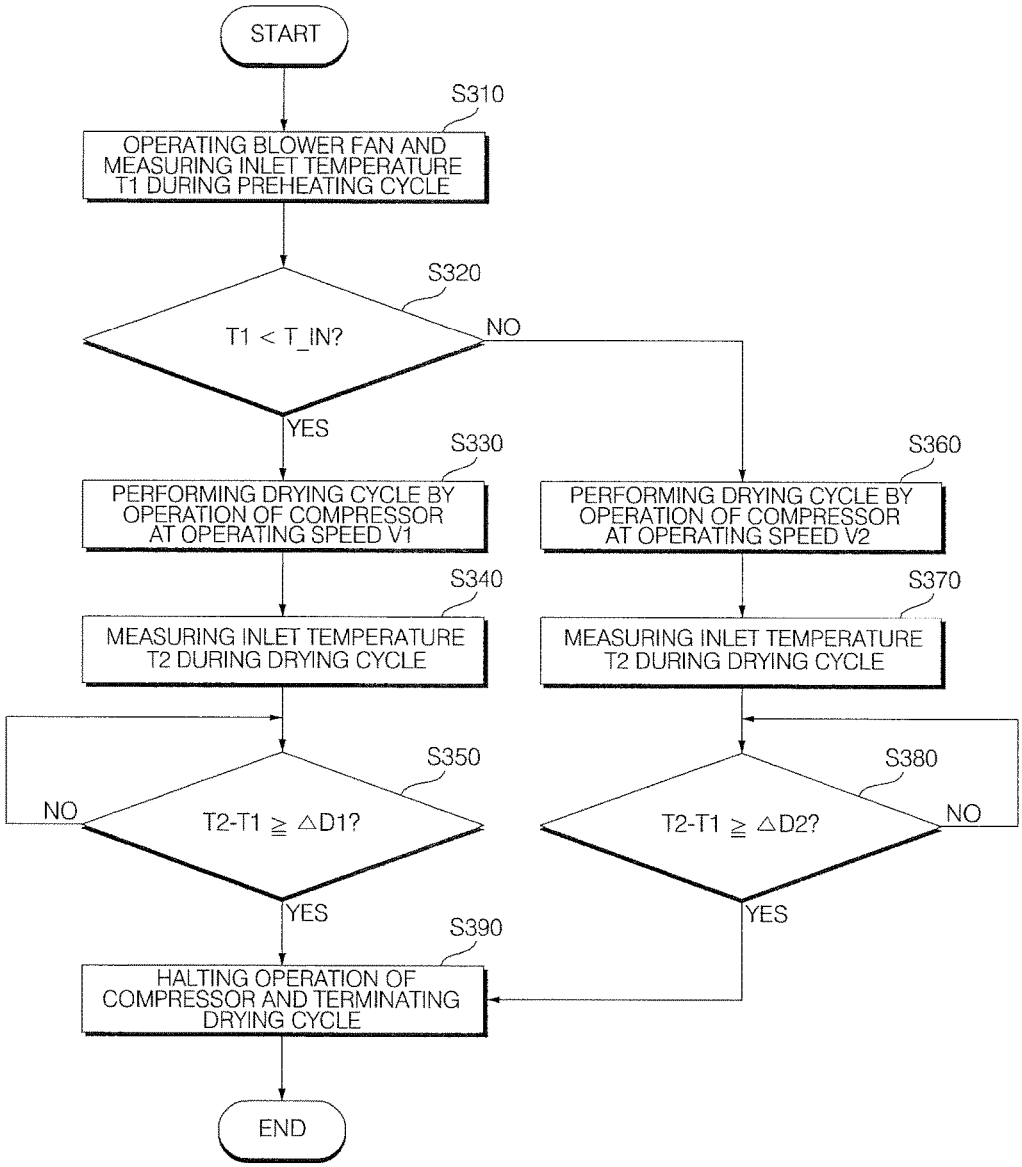
FIG. 6 is a flowchart illustrating an example control process of an example clothes treatment apparatus.

Referring to FIG. 6, in the preheating cycle S210, the control unit 60 operates the blower module 32 without operating the heat pump unit 50, and the inlet temperature sensor 39 measures a preheated inlet temperature T1, which is the temperature value of air drawn by the blower unit 30 (S310). Since the preheated inlet temperature T1, which is measured concurrently with the start of operation of the blower module 32, is almost equal to the indoor temperature in the space in which the clothes treatment apparatus is installed, the control unit 60 controls the heat pump unit 50 based on the preheated inlet temperature T1 during the drying cycle S250.

The control unit 60 determines whether the preheated inlet temperature T1 is lower than the predetermined reference inlet temperature T_in (S320). The reference inlet temperature T_in is set to be 45° C. so as to be prepared for used in torrid zone.

When the preheated inlet temperature T1 is lower than the predetermined reference inlet temperature T_in, the control unit 60 operates the compressor 51 at a predetermined first operating speed V1 in order to perform the drying cycle S250 (S330). The first operating speed V1 is set to be relatively high such that the heat pump unit 50 can heat the air drawn by the blower unit 30 relatively quickly so as to be suitable for the drying cycle in temperate zones.

The control unit 60 operates the compressor 51 at the first operating speed V1, and the inlet temperature sensor 39 consecutively measures a dried inlet temperature T2, which is the temperature of air drawn by the blower unit 30 (S340). The inlet temperature sensor 39 transfers the measured dried inlet temperature T2 to the control unit 60.

The control unit 60 determines whether the difference between the dried inlet temperature T2 measured by the inlet temperature sensor 39 in the drying cycle S250 and the preheated inlet temperature T1 is equal to or greater than a predetermined first reference temperature difference ΔD1 (S350). Here, the dried inlet temperature T2 is a temperature value, which is consecutively measured by the inlet temperature sensor 39 when the compressor 51 is operated, and the preheated inlet temperature T1 is a temperature value, which is measured by the inlet temperature sensor 39 in the preheating cycle S210. The first reference temperature difference ΔD1 is set to be relatively high such that the heat pump unit 50 can supply heated air to the inside of the treatment chamber 12 for a relatively long period of time so as to be suitable for the drying cycle.

When the difference between the dried inlet temperature T2 and the preheated inlet temperature T1 is less than the first reference temperature difference ΔD1, the control unit 60 consecutively measures the dried inlet temperature T2 and determines whether the difference between the dried inlet temperature T2 and the preheated inlet temperature T1 is equal to or greater than the predetermined first reference temperature difference ΔD1.

When the difference between the dried inlet temperature T2 and the preheated inlet temperature T1 is equal to or greater than the predetermined first reference temperature difference ΔD1, the control unit 60 halts the operation of the compressor 51 and halts the operation of the blower module 32 in order to terminate the drying cycle S250 (S390).

When the preheated inlet temperature T1 is equal to or higher than the predetermined reference inlet temperature T_in, the control unit 60 operates the compressor 51 at a predetermined second operating speed V2 in order to perform the drying cycle S250. The second operating speed V2 is set to be relatively low such that the heat pump unit 50 can relatively slowly heat the air drawn by the blower unit 30 so as to be suitable for the drying cycle in a torrid zone. Here, the second operating speed V2 is set to be lower than the first operating speed V1.

The control unit 60 operates the compressor 51 at the second operating speed V2, and the inlet temperature sensor 39 consecutively measures the dried inlet temperature T2, which is the temperature of the air drawn into the blower unit 30 (S370). The inlet temperature sensor 39 transfers the measured dried inlet temperature T2 to the control unit 60.

The control unit 60 determines whether the difference between the dried inlet temperature T2 measured by the inlet temperature sensor 39 and the preheated inlet temperature T1 is equal to or higher than a predetermined second reference temperature difference ΔD2 (S380). The dried inlet temperature T2 is a temperature value that is repeatedly measured by the inlet temperature sensor 39 when the compressor 51 is operated, and the preheated inlet temperature T1 is a temperature value that is measured by the inlet temperature sensor 39 in the preheating cycle S210. The second reference temperature difference ΔD2 is set to be relatively small such that the heat pump unit 50 can supply heated air to the inside of the treatment chamber 12 for a relatively short period of time so as to be suitable for the drying cycle in a torrid zone. Here, the second reference temperature difference ΔD2 is set to be less than the first reference temperature difference ΔD1.

When the difference between the dried inlet temperature T2 and the preheated inlet temperature T1 is less than the second reference temperature difference ΔD2, the control unit 60 repeatedly measures the dried inlet temperature T2, and determines whether the difference between the dried inlet temperature T2 and the preheated inlet temperature T1 is equal to or greater than the predetermined second reference temperature difference ΔD2.

When the difference between the dried inlet temperature T2 and the preheated inlet temperature T1 is equal to or greater than the predetermined second reference temperature difference ΔD2, the control unit 60 halts the operation of the compressor 51 and halts the operation of the blower module 32 in order to terminate the drying cycle S250 (S390).

The clothes treatment apparatus and a method of controlling the same provide at least one of the following effects.

First, it is possible to check a temperature in the space in which the clothes treatment apparatus is installed by operation of the blower module for circulating air during preheating of the steam unit.

Second, it is also possible to efficiently perform a drying cycle by controlling the heat pump unit, which is adapted to perform a drying cycle in accordance with the ambient temperature in the environment in which the clothes treatment apparatus is installed.

Third, it is also possible to efficiently perform a drying cycle by controlling the operating speed of the compressor of the heat pump unit in accordance with the ambient temperature condition in the environment in which the clothe treatment apparatus is installed.

Fourth, it is also possible to efficiently perform a drying cycle by determining whether to halt the operation of the heat pump unit based on the temperature in the space in which the clothes treatment apparatus is installed and the temperature in the treatment chamber, which accommodates clothes, when the heat pump unit is operated.

What is claimed is:

1. A clothes treatment apparatus comprising:

a case that defines a treatment chamber that is configured to receive clothes;

a steam unit that is configured to supply steam to the treatment chamber and that comprises a heater that is configured to heat water;

a blower unit that is configured to draw air from the treatment chamber;

an inlet temperature sensor that is configured to measure an inlet temperature of air drawn from the treatment chamber and by the blower unit;

a heat pump unit that is configured to heat air drawn by the blower unit and that is configured to supply heated air to the treatment chamber; and a control unit that is configured to:

preheat the heater by supplying power to the heater, draw air from the treatment chamber without operating the heat pump unit, at a time that the blower unit begins to operate, determine that a preheated inlet temperature (T1) is the inlet temperature, after preheating the heater, supply steam to the treatment chamber by operating the steam unit, after halting operation of the steam unit, lower a temperature inside the treatment chamber by operating the blower unit, based on the preheated inlet temperature (T1) being equal to or higher than a predetermined reference inlet temperature (T_in), control the heat pump unit to heat air, that is drawn by the blower unit, at a slower rate than based on the preheated inlet temperature (T1) being lower than the reference inlet temperature (T_in), and discharge heated air into the treatment chamber by operating the blower unit.

2. The clothes treatment apparatus according to claim 1, wherein the control unit is configured to:

at a time that the control unit operates the heat pump unit, determine that a dried inlet temperature (T2) is the inlet temperature, and based on comparing the dried inlet temperature (T2) to the preheated inlet temperature (T1), control the heat pump unit.

3. The clothes treatment apparatus according to claim 2, wherein the control unit is configured to control the heat pump unit by:

based on determining that (i) the preheated inlet temperature (T1) is lower than a predetermined reference inlet temperature (T_in), and (ii) a difference between the dried inlet temperature (T2) and the preheated inlet temperature (T1) is equal to or higher than a predetermined first reference temperature difference (ΔD1), halting operation of the heat pump unit, and based on determining that (i) the preheated inlet temperature (T1) is equal to or higher than the reference inlet temperature (T_in), and (ii) a difference between the dried inlet temperature (T2) and the preheated inlet temperature (T1) is equal to or higher than a predetermined second temperature difference (ΔD2), halting operation of the heat pump unit, wherein the second reference temperature difference (ΔD2) is less than the first reference temperature difference (ΔD1).

4. The clothes treatment apparatus according to claim 1, wherein:

the heat pump unit includes a compressor that is configured to compress refrigerant and a condenser that is configured to exchange heat between the refrigerant compressed by the compressor and the air drawn by the blower unit, the control unit is configured to operate the compressor at a predetermined first operating speed (V1) based on the preheated inlet temperature (T1) being lower than a predetermined reference inlet temperature (T_in), the control unit is configured to operate the compressor at a predetermined second operating speed (V2) based on the preheated inlet temperature (T1) being equal to or higher than the reference inlet temperature (T_in), and the second operating speed (V2) is lower than the first operating speed (V1).

5. The clothes treatment apparatus according to claim 4, wherein:

the control unit is configured to halt operation of the compressor based on a difference between a dried inlet temperature (T2), that the inlet temperature sensor measures while the compressor operates at the first operating speed (V1), and the preheated inlet temperature (T1) being equal to or higher than a first reference temperature difference (ΔD1), the control unit is configured to halt operation of the compressor based on the difference between a dried inlet temperature (T2), that the inlet temperature sensor measures while the compressor operates at the second operating speed (V2), and the preheated inlet temperature (T1) being equal to or higher than a second reference temperature difference (ΔD2), and the second reference temperature difference (ΔD2) is less than the first reference temperature difference (ΔD1).

6. A method of controlling a clothes treatment apparatus that comprises:

a case that defines a treatment chamber that is configured to receive clothes;

a steam unit that is configured to supply steam to the treatment chamber;

a blower unit that is configured to draw air from the treatment chamber;

an inlet temperature sensor that is configured to measure an inlet temperature of air drawn by the blower unit; and a heat pump unit that is configured to heat air drawn by the blower unit and that is configured to supply heated air to the treatment chamber, the method comprising:

preheating the heater by supplying power to the heater;

drawing air from the treatment chamber without operating the heat pump unit;

at a time that the blower unit begins to operate, determining that a preheated inlet temperature (T1) is the inlet temperature;

after preheating the heater, supplying steam to the treatment chamber by operating the steam unit;

after halting operation of the steam unit, lowering a temperature inside the treatment chamber by operating the blower unit;

based on the preheated inlet temperature (T1) being equal to or higher than a predetermined reference inlet temperature (T_in), controlling the heat pump unit to heat air, that is drawn by the blower unit, at a slower rate than based on the preheated inlet temperature (T1) being lower than the reference inlet temperature (T_in); and discharging heated air into the treatment chamber by operating the blower unit.

7. The method according to claim 6, comprising:

at a time that the heat pump unit begins to operate, determining that a dried inlet temperature (T2) is the inlet temperature; and based on comparing the dried inlet temperature (T2) to the preheated inlet temperature (T1), controlling the heat pump unit.

8. The method according to claim 7, wherein controlling the heat pump unit comprises:

based on determining that (i) the preheated inlet temperature (T1) is lower than a predetermined reference inlet temperature (T_in), and (ii) a difference between the dried inlet temperature (T2) and the preheated inlet temperature (T1) is equal to or greater than a predetermined first reference temperature difference (ΔD1), halting operation of the heat pump unit, and based on determining that (i) the preheated inlet temperature (T1) is equal to or higher than the predetermined reference inlet temperature (T_in), and (ii) a difference between the dried inlet temperature (T2) and the preheated inlet temperature (T1) is equal to or greater than a predetermined second reference temperature difference (ΔD2), halting operation of the heat pump unit, wherein the second reference temperature difference (ΔD2) is less than the first reference temperature difference (ΔD1).

9. The method according to claim 6, wherein:

the heat pump unit includes a compressor that is configured to compress refrigerant and a condenser that is configured to exchange heat between the refrigerant compressed by the compressor and the air drawn by the blower unit, the compressor is configured to operate at a predetermined first operating speed (V1) based on the preheated inlet temperature (T1) being lower than a predetermined reference inlet temperature (T_in), the compressor is configured to operate at a predetermined second operating speed (V2) based on the preheated inlet temperature (T1) being equal to or higher than a predetermined reference inlet temperature (T_in), and the second operating speed (V2) is lower than the first operating speed (V1).

10. The method according to claim 9, comprising:

halting operation of the compressor based on a difference between a dried inlet temperature (T2), that the inlet temperature sensor measures while the compressor operates at the first operating speed (V1), and the preheated inlet temperature (T1) being equal to or higher than a first reference temperature difference (ΔD1); and halting operation of the compressor based on the difference between a dried inlet temperature (T2), that the inlet temperature sensor measures while the compressor operates at the second operating speed (V2), and the preheated inlet temperature (T1) being equal to or higher than a second reference temperature difference (ΔD2), wherein the second reference temperature difference (ΔD2) is less than the first reference temperature difference (ΔD1).

* * * * *